US011274837B2

(12) United States Patent
Benzinger

(10) Patent No.: US 11,274,837 B2
(45) Date of Patent: Mar. 15, 2022

(54) SYSTEM AND METHOD FOR NATURAL AIR CONDITIONING

(71) Applicant: Robert Benzinger, Annapolis, MD (US)

(72) Inventor: Robert Benzinger, Annapolis, MD (US)

( * ) Notice: Subject to any disclaimer, the term of this patent is extended or adjusted under 35 U.S.C. 154(b) by 0 days.

(21) Appl. No.: 17/065,069

(22) Filed: Oct. 7, 2020

(65) Prior Publication Data

US 2021/0215357 A1 Jul. 15, 2021

Related U.S. Application Data

(60) Provisional application No. 62/961,378, filed on Jan. 15, 2020.

(51) Int. Cl.
*F24F 1/0358* (2019.01)
*F24F 1/0355* (2019.01)

(52) U.S. Cl.
CPC ..... *F24F 1/0358* (2019.02); *F24F 1/0355* (2019.02)

(58) Field of Classification Search
CPC ..... F24F 1/0358; F24F 1/0083; F24F 1/02; F24F 8/50; F24F 8/108; F24F 1/0355; F24F 5/0035; F25B 17/08
See application file for complete search history.

(56) References Cited

U.S. PATENT DOCUMENTS

| | | | |
|---|---|---|---|
| 5,737,938 | A | 4/1998 | Liu |
| 6,701,724 | B2 | 3/2004 | Smith et al. |
| 2017/0234554 | A1 | 8/2017 | Al-Madhoun et al. |

FOREIGN PATENT DOCUMENTS

| | | | | |
|---|---|---|---|---|
| CN | 105814368 | A | | 7/2016 |
| CN | 109539414 | A | * | 3/2019 |
| KR | 101662315 | B1 | | 10/2016 |
| WO | 2019162949 | A1 | | 8/2019 |

OTHER PUBLICATIONS

CN109539414A Translation (Year: 2019).*
Reduce indoor humidity without a dehumidifer, Vivien Mah, https://www.andatechdistribution.com.au/blogs/news/reduce-indoor-humidity-without-dehumidifier (Year: 2019).*
Stone, The Original Green Building Material, Brent Ehrlich, https://www.buildinggreen.com/feature/stone-original-green-building-material (Year: 2013).*
K. Mok, "Natural Air Conditioner Cools With the Power of Terracotta and Evaporation," 2018.
S. Kashetti, "These 'Pot Coolers' Cost Just ₹ 1500 & Will Charge Only ₹ 19 Current Bill Monthly!," 2018.

* cited by examiner

*Primary Examiner* — Schyler S Sanks
(74) *Attorney, Agent, or Firm* — 24IP Law Group USA, PLLC; Timothy DeWitt

(57) ABSTRACT

An air conditioning system comprising a housing having an internal cavity, said cavity having an entrance and an exit, wherein said housing is made from at least one of terra cotta, brick or stone; a first layer of sea salt in said cavity; a layer of a drying agent on said layer of sea salt in said cavity; a second layer of sea salt on said layer of drying agent in said cavity; and a pump connected to said cavity exit; wherein said pump draws air in through said cavity entrance, through said second sea salt layer, said drying agent layer and at least a portion of said first sea salt layer and out through said cavity exit.

3 Claims, 4 Drawing Sheets

SYSTEM AND METHOD FOR NATURAL AIR CONDITIONING

CROSS-REFERENCE TO RELATED APPLICATIONS

The present application claims the benefit of the filing date of U.S. Provisional Patent Application Ser. No. 62/961,378 filed by the present inventors on Jan. 15, 2020.

The aforementioned provisional patent application is hereby incorporated by reference in its entirety.

STATEMENT REGARDING FEDERALLY SPONSORED RESEARCH OR DEVELOPMENT

None.

BACKGROUND OF THE INVENTION

Field of the Invention

The present invention relates to controlling the temperature of air in an enclosed space, and more specifically, to a system and method for maintaining air within a closed environment at a moderate temperature using all natural elements.

Brief Description of the Related Art

A variety of cooling systems have been proposed, including commonly known systems using freon and like. Such systems suffer from significant drawbacks in terms of energy use and harm to the environment.

Other systems have proposed using solar energy. One such example is disclosed in U.S. Pat. No. 4,010,620, entitled "Cooling System." The '620 patent proposed a system for cooling a building use a method having the steps of (1) creating a cold solution by adding water to a salt or mixture of salts being characterized as having an endothermic heat of solutions, (2) passing air over or through the solution or in contact with a hear exchanger container containing the solution in order to cool the air and warm the solution, passing the cooled air into the building to cool the building, and after the potential cooling effect is exhausted, passing heated air through the solution to evaporate the water and reform the salt for reuse, the heated air being heated at least in part by solar heat.

SUMMARY OF THE INVENTION

In a preferred embodiment, the present invention is and air conditioning system comprising a housing having an internal cavity, said cavity having an entrance and an exit, wherein said housing is made from at least one of terra cotta, brick or stone; a first layer of sea salt in said cavity; a layer of a drying agent on said layer of sea salt in said cavity; a second layer of sea salt on said layer of drying agent in said cavity; and a pump connected to said cavity exit; wherein said pump draws air in through said cavity entrance, through said second sea salt layer, said drying agent layer and at least a portion of said first sea salt layer and out through said cavity exit.

Still other aspects, features, and advantages of the present invention are readily apparent from the following detailed description, simply by illustrating a preferable embodiments and implementations. The present invention is also capable of other and different embodiments and its several details can be modified in various obvious respects, all without departing from the spirit and scope of the present invention. Accordingly, the drawings and descriptions are to be regarded as illustrative in nature, and not as restrictive. Additional objects and advantages of the invention will be set forth in part in the description which follows and in part will be obvious from the description or may be learned by practice of the invention.

BRIEF DESCRIPTION OF THE DRAWINGS

For a more complete understanding of the present invention and the advantages thereof, reference is now made to the following description and the accompanying drawings, in which.

DETAILED DESCRIPTION OF THE PREFERRED EMBODIMENTS

Figure 1:
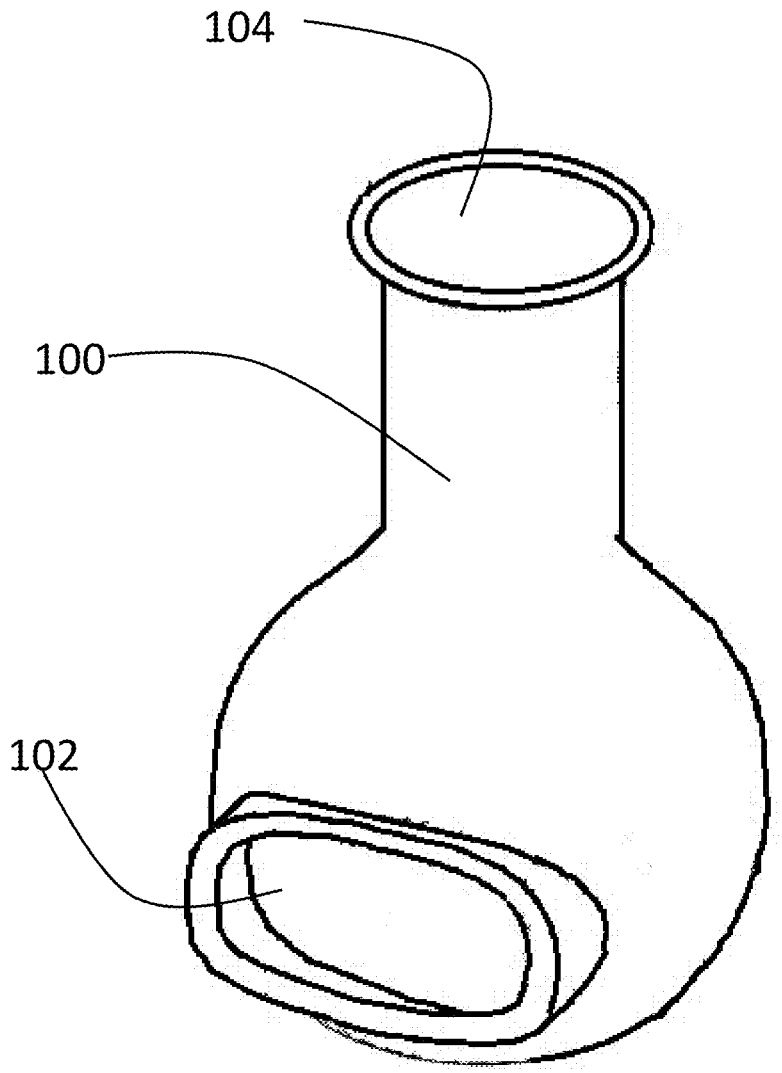
FIG. 1 is a perspective view of a chiminea that may be used as a housing in a preferred embodiment of the present invention.
Figure 2:
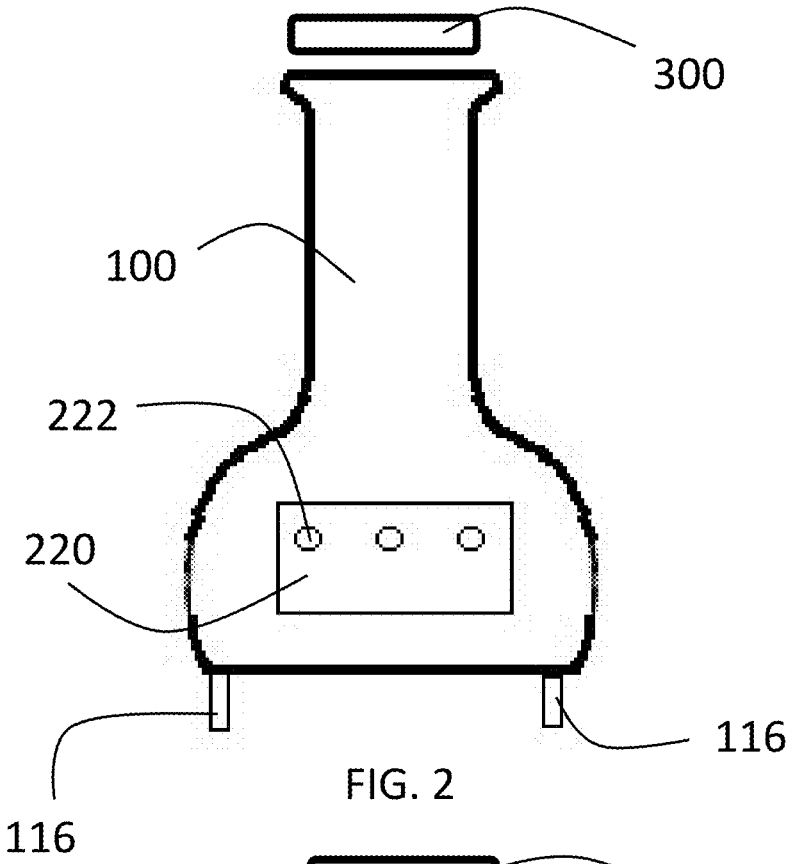
FIG. 2 is front view of a natural air conditioning system in accordance with a preferred embodiment of the present invention.
Figure 3:
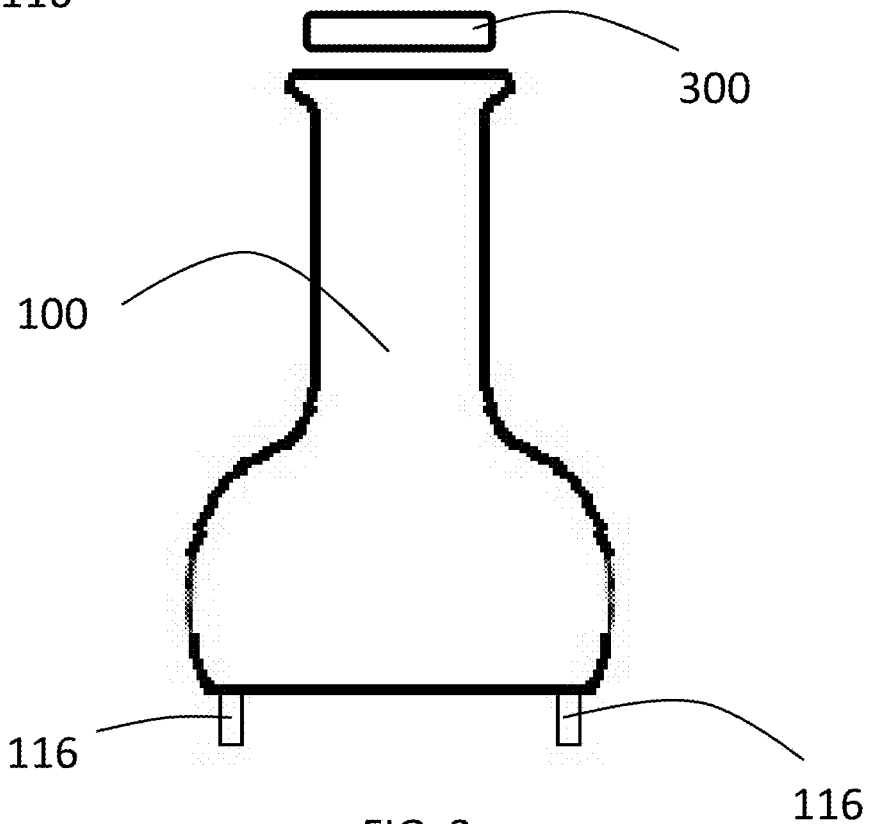
FIG. 3 is a rear view of a natural air conditioning system in accordance with a preferred embodiment of the present invention.
Figure 4:
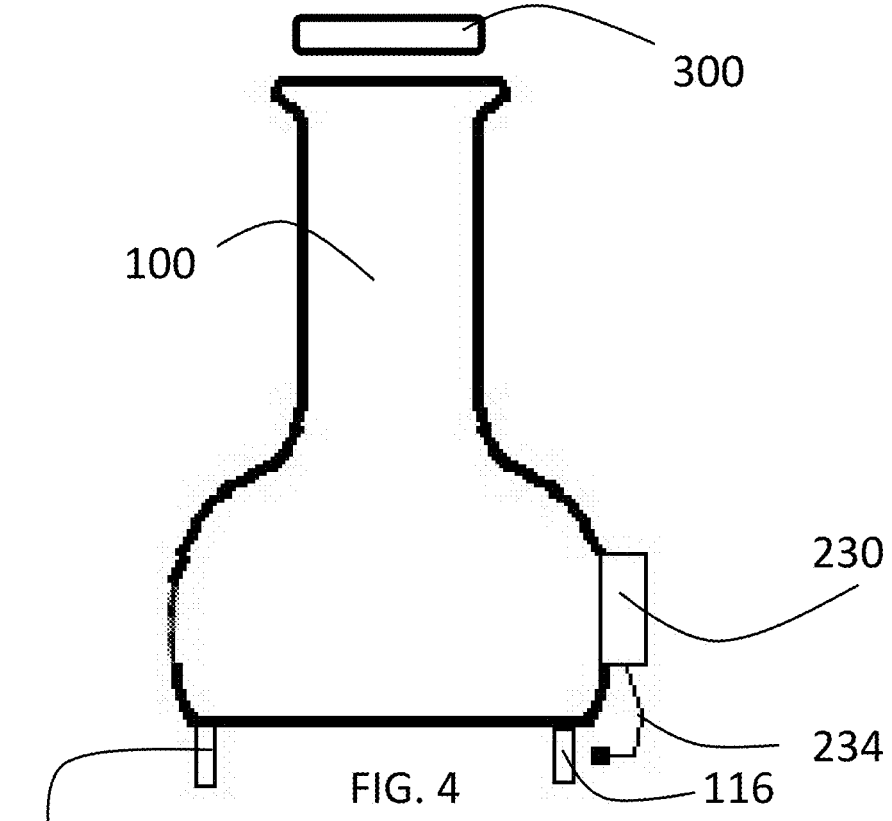
FIG. 4 is a left side view of a natural air conditioning system in accordance with a preferred embodiment of the present invention.
Figure 5:
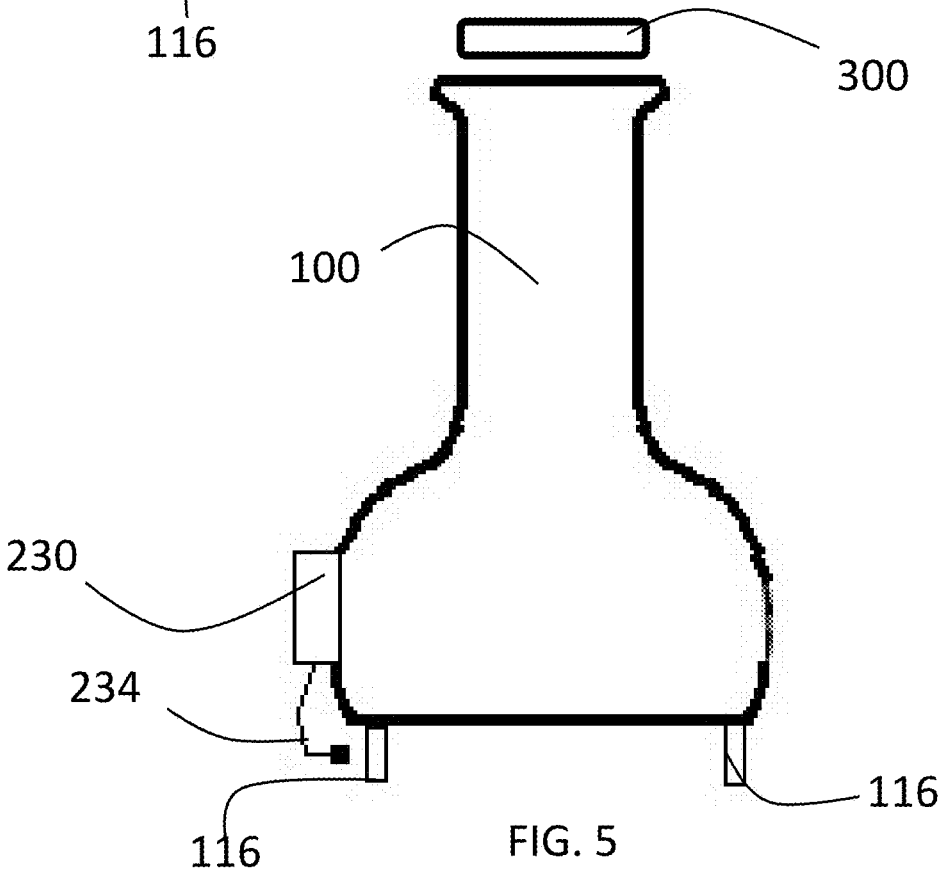
FIG. 5 is a right side view of a natural air conditioning system in accordance with a preferred embodiment of the present invention.

The preferred embodiments of the inventions are described with reference to the drawings. In the preferred embodiment shown in FIGS. 1-5, the natural air conditioning system of the present invention has a housing 100 such as a chiminea made from terra cotta or brick or the like. The housing 100 has a hollow body and an air intake opening 104 at the top and an air exit 102 at the bottom. As shown in FIG. 5, the hollow body of the housing 100 is filled with a first solar salt layer 112, a drying agent layer 120, a second solar salt layer 114, and a dust filter/essential oil repository 130. Other arrangements of layers, such as having a second drying agent layer below the solar salt layer 112 additional is possible with the present invention. The drying agent may be a material akin to products known as "Kitty Litter," which can be clay-based, bentonite, or biodegradable materials. The housing 100 may have a lid 300 for placement over the air intake 114. The housing 100 may be placed on a platform or legs 116 or may rest on the ground. The housing further may have a structure such that any drying agent layers may be removed and replaced and for re-filling or replacing the solar salt layers. For example, the housing 110 could have drawers for the various layers that could be removed, emptied and refilled as needed. Such drawers or other structures, however, are not necessary components of the invention.

In the air exit 112 at the bottom of the housing is an air pump 230, a filter screen 220 and a plurality of openings 222, for example, for connecting an output hose such as a soaker hose. While three openings 222 are shown in the drawings, the invention can be used with a single opening or many openings. The air pump 220 may have an electrical plug 234 or other source of power, such as batteries or, for example, a solar power source.

The present invention has many benefits, including that it is nearly silent, efficient, portable, and capable of use with forced air and ambient in floor and ceiling applications. Additional features/options of the invention can be the following:

- Adjustable air flow
- Multiple power source options
- Low maintenance
- Solar salt and natural kitty litter blend form the base temperature and humidity control and scent (which can be customized using essential oils).
- Constant temperature, approximately 65°-70°
- Can be retrofitted to fireplaces
- Energy efficient (15-25 or bigger air pump) (larger wattage)
- Attractive appearance (Chimenea)
- Can be used inside any room, enhancing décor depending on personal choice of materials (terra cotta, iron, brick, etc.)

The following procedure may be applied for using the inventor:

1) Place air pump in bottom of Chiminea with intake facing up. Plug in, cover intake with solid cover,
2) Cover pump with solar salt after attaching soaker hose to pump (air out). Then add layer if kitty litter for moisture absorption. Make sure pump is on.
3) Secure top lid and lay unit down to fill with solar salt and kitty litter or Meerschaum blend (3 to 1 or more)
4) Secure webbing to front and stand unit up.
5) Run soaker hose throughout room or attached to radiant heat/cooling panel in floor or ceiling.

Additional options for the invention include the following:

- Unit can be placed in basement or crawl space with multiple hoses (with holes (soaker hose)) running through existing duct work (duct must run from living space to unit air in)
- Soaker hose can be concealed behind molding provided narrow gap is left to allow proper air flow (floor or ceiling molding)
- Optional plug in to ambient cooling sub floor
- Unit can also be placed in well insulated adjacent building
- Existing brick fireplaces can be retrofitted with this technology. In this application the solar salt and cat litter should be kept in mesh bags for ease of installation and removal. Front cover still required with hole for air out.

Air Pump Options:

Air pump 220 need not necessarily be placed inside the Chimenea, rather it could be placed below (A), beside (B), or on top (C). As long as the air sucked into the pump has been pulled from the constant temperature and humidity in the interior of the Chimenea.

Further, the main Chimenea could be modified to hold and attachment which contains the air pump 220. The attachment could be made of clay, stone or iron or any other material. The main purpose is to have it be sound insulated. As long as the air into the pup is drawn from the main Chimenea and air out through the attachment located on the top side or bottom.

Whole House System:

One can Air Soften an entire home or business by placing enough units and solar salt/cat litter and air pumps throughout.

Optionally, one could fill a substrate beneath the house with the solar salt/cat litter mix and draw air from below using as many air pumps as needed.

The above would work best in new construction and should be placed above any water channeling gravel (to basement sump pump).

Figure 6:
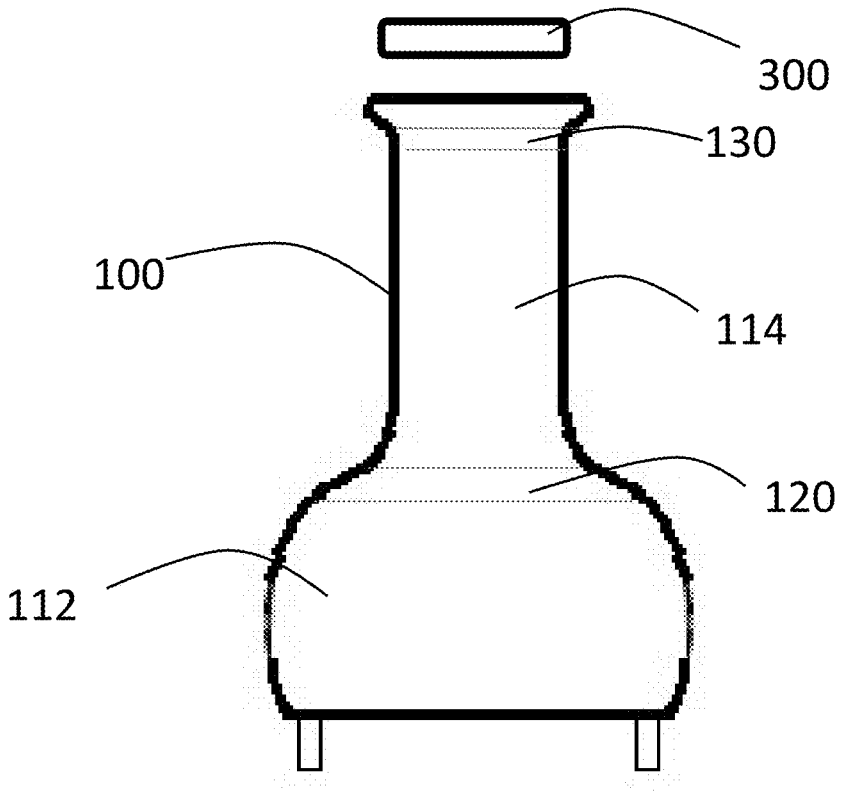
FIG. 6 is a front cross-sectional view of a natural air conditioning system in accordance with a preferred embodiment of the present invention.

Scenting Options:

By placing a small sieve 130 filled with essential oil soaked drying agent can provide a delightful scents to the soft air. The sieve is placed on the air in end of the Chimenea as shown in FIG. 6.

Clever Placements and Modifications:

Soft Air Units are very useful in musty and dusty environment such as basements and cellars or attics. The unit will keep the air moving so as not to become stale. This helps preserve and protect items in storage from mold and mildew.

In the above application we recommend a higher percentage of cat litter vs. solar salt for its moisture absorbing qualities. Meerschaum stone would work well also.

For wine cellar use it is best to run ambient Soft Air through subfloor, in wall, and/or ceiling. Several ⅜" tubes from main unit would do the job.

Use as Supplemental to Traditional HVAC

As much as the Soft Air unit benefits the environment by maintaining ideal temperature and humidity levels (humidity approximately 50%), the units can be used supplemental with existing HVAC systems. Examples being inside a store or restaurant in a mall or in and individual office building. Both are settings without fresh air circulation/The Soft Air system's salts from the sea replicates all of the health benefits of being by the sea without leaving the city. It also filters out dust and gives the olfactory joy along with it.

Portability

The Soft Air(e) units are rather heavy, so in order to move them from room to room easily they should be on wheels. A platform or legs with wheels such as those used to hold large, heavy indoor potted plants would work, equally, caster wheels that attached directly to the Soft Air(e) unit would do. For example, during a heat wave, if one's apartment is not equipped with A/C one could keep the unit in the living area by day and wheel it into the bedroom in the evening and plug it in, therefore a good night's sleep. (Ideally buy multiple units). Conversely, the same science applies if it's cold because the unit will heat that air to 65°-70° F.

Solar Salt Variables & Negative Ions

There are many different types of solar salts. As long as they are coarse, they will work to regulate air quality temperature and humidity (with the drying agent). Beyond that salts from different seas offer specific spirituality. It is proven that salts from the ancient Pink Salt Mines of Nepal generate negative ions which improve moods and lift spirits and heal. Dead Sea Salts, Mediterranean Spa Salts, Celtic Salt, Maldon Sea Salt and from the Caribbean Bonaire Salt offer the mood of the Caribbean, bringing any regional sea salt to any room anywhere along with its many benefits (mood, spirit, appetite) is now possible! Even muscle relaxing Epsom salts can be used.

Supplemental Soft Air(e)

Soft Air(e) Chimenea Units can be incorporated onto or added to existing HVAC Systems with the benefits if improving air quality and helping to heat or cool the house.

Simply run the soaker hose from the Chiminea into the air out of the existing heat exchanger. Ideally run the soaker hose throughout existing duct work. Because the Soft Air(e) units run continually fresh clean 65°-70° F. Air will be constantly circulated and 50% humidity help alleviate strain on existing A/C units. The supplemental heating also saves money.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. An air conditioning system comprising:

a housing having an internal cavity, said cavity having an entrance and an exit, wherein said housing is made from at least one of terra cotta, brick or stone;

a first layer of sea salt in said cavity;

a layer of a drying agent on said layer of sea salt in said cavity;

a second layer of sea salt on said layer of drying agent in said cavity; and a pump connected to said cavity exit;

wherein said pump draws air in through said cavity entrance, through said second sea salt layer, said drying agent layer and at least a portion of said first sea salt layer and out through said cavity exit; and wherein said housing comprises a chiminea.

2. An air conditioning system comprising:

a housing having an internal cavity, said cavity having an entrance and an exit, wherein said housing is made from at least one of terra cotta, brick or stone;

a first layer of sea salt in said cavity;

a layer of a drying agent on said layer of sea salt in said cavity;

a second layer of sea salt on said layer of drying agent in said cavity; and a pump connected to said cavity exit;

wherein said pump draws air in through said cavity entrance, through said second sea salt layer, said drying agent layer and at least a portion of said first sea salt layer and out through said cavity exit; and an essential oil repository in said cavity on said second sea salt layer.

3. The air conditioning system according to claim 2 wherein said essential oil repository comprising a sieve filled with a drying agent soaked with an essential oil.

* * * * *